US009297239B2

(12) United States Patent
López Robayo

(10) Patent No.: US 9,297,239 B2
(45) Date of Patent: Mar. 29, 2016

(54) SMART HYDRAULIC PUMPING DEVICE FOR RECOVERY OF OIL AND OBTAINING OF INFORMATION FROM THE BOTTOM OF THE RESERVOIR

(76) Inventor: Byron Raúl López Robayo, Quito (EC)

( * ) Notice: Subject to any disclaimer, the term of this patent is extended or adjusted under 35 U.S.C. 154(b) by 995 days.

(21) Appl. No.: 13/457,816

(22) Filed: Apr. 27, 2012

(65) Prior Publication Data

US 2012/0273221 A1 Nov. 1, 2012

(30) Foreign Application Priority Data

Apr. 27, 2011 (EC) ..... 11-11007

(51) Int. Cl.
*E21B 43/12* (2006.01)

(52) U.S. Cl.
CPC ..... *E21B 43/124* (2013.01)

(58) Field of Classification Search
CPC ..... E21B 43/124; E21B 43/121; E21B 2034/002; F04F 5/48; F04F 5/54
See application file for complete search history.

(56) References Cited

U.S. PATENT DOCUMENTS

| | | | | |
|---|---|---|---|---|
| 1,355,606 | A | | 10/1920 | Ingram |
| 1,758,376 | A | | 5/1930 | Sawyer |
| 2,041,803 | A | | 5/1936 | Wolff |
| 2,080,623 | A | | 5/1937 | McMahon |
| 2,285,638 | A | | 6/1942 | Amtsberg |
| 2,287,076 | A | | 6/1942 | Zachry |
| 2,826,994 | A | | 3/1958 | Slater |
| 3,215,087 | A | | 11/1965 | McLeod |
| 3,234,890 | A | | 2/1966 | Adams et al. |
| 3,887,008 | A | | 6/1975 | Canfield |
| 4,135,861 | A | | 1/1979 | Brown et al. |
| 4,183,722 | A | | 1/1980 | Roeder |
| 4,293,283 | A | | 10/1981 | Roeder |
| 4,310,288 | A | | 1/1982 | Erickson |
| 4,390,061 | A | | 6/1983 | Short |
| 4,441,861 | A | | 4/1984 | Canalizo |
| 4,504,195 | A | | 3/1985 | Binks et al. |
| 4,603,735 | A | | 8/1986 | Black |
| 4,605,069 | A | | 8/1986 | McClaflin et al. |
| 4,658,693 | A | | 4/1987 | Hennessey |
| 4,664,603 | A | | 5/1987 | Priestly |
| 4,726,420 | A | | 2/1988 | Weeks |
| 4,744,730 | A | | 5/1988 | Roeder |
| 4,790,376 | A | | 12/1988 | Weeks |
| 4,846,280 | A | * | 7/1989 | Snider ..... 166/372 |
| 5,055,002 | A | | 10/1991 | Roeder |

(Continued)

FOREIGN PATENT DOCUMENTS

EC SMU-01-4158 1/2003

*Primary Examiner* — Giovanna C Wright
*Assistant Examiner* — Kristyn Hall
(74) *Attorney, Agent, or Firm* — Kilpatrick Townsend & Stockton LLP

(57) ABSTRACT

A hydraulic pump smart device for production of oil, recording of pressure and temperature, temporary closing and leveling of pressure in a single and simple operation is provided. The intelligent hydraulic pumping device includes a jet pump assembly coupled with a bottom shut-off valve and is coupled to a gauge carrier, forming an integrated single-block unit. A bottom shut-off valve is incorporated into to the jet pump and is closed by a system of a plunger and two balls. The recovery of the smart device is generated by the opening of a by-pass on injecting a drive fluid in reverse at a low pressure (approximately 100 to 500 psi).

13 Claims, 8 Drawing Sheets

Completion diagram of a well according to the invention

(56) References Cited

U.S. PATENT DOCUMENTS

| | | | | |
|---|---|---|---|---|
| 5,083,609 | A | 1/1992 | Coleman | |
| 5,372,190 | A | 12/1994 | Coleman | |
| 5,472,054 | A | 12/1995 | Hinds | |
| 5,651,664 | A | 7/1997 | Hinds et al. | |
| 5,667,364 | A | 9/1997 | O Mara et al. | |
| 6,053,261 | A * | 4/2000 | Walter | 175/234 |
| 6,354,371 | B1 | 3/2002 | O'Blanc | |
| 2012/0168146 | A1 * | 7/2012 | Filas | 166/66.5 |

* cited by examiner

Completion diagram of a well according to the invention

A.- Plug
B.- Injection Line
C.- Production output line
D.- Casing
E.- Tubing
F.- Sliding sleeve
G.- Discharge of fluid
H.- Smart device
I.- Packing
J.- Short tube
K.- No go (No-Go)
L.- Production reservoir
M.- Drainage orifices
N.- Formation fluid
P.- Well head

Smart hydraulic pumping device

I.- Jet pump
II.- Bottom shut-off valve
III.- Jet pump housing
IV.- Electronic gauge housing
14. Outer tube 1
12. Smart connector
28. Smart Bottom plug

Jet pump (I)

1. Fishing neck
2. Upper packing mandrel
3. Centre adapter
4. Chevron packing
5. End adapter
6. Adapter extension
7. O-ring
8. Nozzle
9. Nozzle retainer
10. Throat
11. O-ring 2
12. Smart connector
13. Diffuser
15. Outer Tube 2
16. Discharge body

Detail of the discharge body

Detail of the nozzle –throat unit

16. Discharge body
16 A. Entry ducts of the reservoir fluid to the pump
16 B. Discharge ducts of the fluid mixture 8. Nozzle
9. Nozzle retainer
10. Throat
3B1. Drive fluid
3B2. Reservoir fluid
3B3. Drive fluid + reservoir fluid

Bottom shut-off valve (II)

17. End adapter
18. Chevron packing
19. Centre adapter
21. O-ring 2
22. O-ring 2
23. By-pass
24APlunger assembly upper part
24B Plunger assembly lower
25A Upper ball
25B Lower ball
26. Spring
27. Metallic O ring
28. Smart bottom plug
35. Smart valve housing

Position of the plunger (24) in the opening

And closing of the bottom valve

Detail of the smart connector coupling and the valve housing

12. Smart connector
23. By-pass ducts
35. Smart valve housing

Position of the by-pass in the smart valve housing

23. By-pass ducts
35. Smart valve housing

Jet pump housing (III)

14. Outer tube 1
17. End Adapter
18. Chevron packing
19. Centre adapter
20. Upper packing mandrel
34. Screw

Electronic gauge housing (IV)

29. Gauge carrier
30. Spring 2
31. Housing MG Teflon 2
32. Fluid to gauge entry ducts
33. Retainer nut & carrier
36. Electronic gauges (2)
37. Ducts for entry of fluid from the reservoir to the jet pump

SMART HYDRAULIC PUMPING DEVICE FOR RECOVERY OF OIL AND OBTAINING OF INFORMATION FROM THE BOTTOM OF THE RESERVOIR

This application claims priority to Ecuadorian Patent Application No. SP-11-11007, filed on Apr. 27, 2011, which is incorporated herein by reference.

I.—SCOPE OF THE INVENTION

This invention relates in general to the exploration of oil and gas wells. Specifically the invention relates to a device and method for artificial lifting of oil from a reservoir through a hydraulic pumping system and obtaining of information from the bottom of the reservoir.

II.—BACKGROUND OF THE INVENTION

In the traditional practice of oil production, different forms of artificial lifts have been solely based on lifting the production fluid through pressure differentials. For this purpose, mechanical, electrical, hydraulic and screw pumps are installed at the bottom of the well. To define which of the artificial lift methods will be applied on a given well, information about the reservoir is required to be known (pressures, temperatures, characteristics of the well fluids and the flow rate produced by the same). Part of this information (fluid and flow rate characteristics), can be obtained on the surface, making the well operate, while the reservoir pressures and the temperature are recorded at the bottom of the well.

In the current state of the art a large variety of jet pumps for development, testing and operation of oil and gas wells are known, as disclosed in the following patents can be cited U.S. Pat. Nos. 1,355,606; 1,758,376; 2,041,803; 2,080,623; 2,285,638; 2,287,076; 2,826,994; 3,215,087; 3,234,890; 3,887,008; 4,135,861; 4,183,722; 4,293,283; 4,310,288; 4,390,061; 4,441,861; 4,504,195; 4,603,735; 4,605,069; 4,658,693; 4,664,603; 4,726,420; 4,744,730; 4,790,376; 5,055,002; 5,083609; 5,372,190; 5,472,054; 5,651,664; 5,667,364; 6,354,371.

The current state of the art also includes the utility model patent (Ecuador: EC-SMU-01-4158) Hydraulic CLAW Jet Pump, of the same inventor, for lifting of fluids in oil wells, that is incorporated in this invention by reference. The present invention has been envisages given the need of the oil industry to have a compact machine that includes benefits such as the closing of the well at the bottom instantaneously, at the depth of the pump to reduce the "full effect" and to achieve very precise recordings for calculation of the tank or well limits. Thus the configuration of the jet pump which is an important part of this invention maintains the fundamentals of the previous model, but additionally features a modification that allows it's assembly, adaptation and functioning to be based on the operational needs of the machine. Among the characteristics that differentiate it is the connector located in the lower part of the pump that permits assembling of the bottom shut-off valve and also keeps the ducts of the bottom shut-off valve by-pass closed and in the upper part of the pump, the adaptor extension, to which screws to secure the pump while it is functioning, are fixed.

Among the most well known traditional techniques to obtain information on the pressures and temperature of the well bottom, the following can be cited:

a. A gauge carrier is screwed on to the tubing for which a reconditioning tower (large equipment) is required to lower the tubing in an approximate time of 10 hours and to take out the tube in a similar time of 10 hours. This procedure is only applied to exploratory wells and not production wells, the reservoir pressures are recorded in a timely manner, in the instant that the discharge takes place and the reservoir begins to flow.
b. Another known technique refers to the utilization of a bottom shut-off valve, that uses nitrogen to execute the closing and measures approximately 6 meters in length and 100 mm (4 inches) in diameter. This operation involves uncertainty because it's closed or open status cannot be determined, thus creating confusion in operational decisions. Besides, an elevator is required for its installation, which is a very risky operation.
c. Yet another known technique refers to a conventional valve that is placed at the bottom of the well (standing valve), which is equipped with a no-go that is screwed on beforehand to the tubing at the desired depth. The recovery of the valve is done with a cable line, which is a process that requires an average time of 6 hours to lower and an equal amount of time to lift, and this is only if it is unseated. Otherwise, it will be recovered by taking out the tubing, which is not a safe procedure and functions when the pressure in the reservoir is low, while when the pressure in the reservoir is higher than the hydrostatic pressure on the valve, it forces it to open upwards, increasing the said "full effect" which causes loss of time, even by a few days. This is evidently not desirable, as there is a considerable loss of production.

None of the methods of the state of the art mentioned above allows the execution of fluid lift and recording of information from the well in optimal conditions, with adequate closing of the bottom of the well with only one single apparatus, as traditionally this is done with independent equipment, which positions the gauges at the bottom of the well with a cable or tubing line, and requires an additional lift system (a pump), all of which makes these more complex, slower processes, involving higher risks and costs.

Thus there is a requirement to have one single device and procedure that allows the execution of one integrated function; lifting of fluids and the recording of information at the bottom of the well by temporary closing of the same.

There is also the need for this closing of the well bottom to take place instantaneously, in order to reduce the "full effect" and allow rapid and precise recording of the parameters for calculation of the reservoir or well limits.

Therefore the objective of this invention is to resolve the issues in the current state of the technique, by means of a smart device that allows artificial lifting of oil and also temporary closing of the well in one single device.

The inventor's experience of more than 25 years in the oil sector, has helped develop of a smart hydraulic pumping device for artificial lifting of oil, obtaining and recording of information from the reservoir bottom, incorporating known techniques of artificial lift with a jet pump, bottom shut-off valve to efficiently record the restoration pressure of the reservoir and temperature through temporary closing of the well in the quickest manner.

III.—BRIEF DESCRIPTION OF THE INVENTION

This invention refers to a smart hydraulic pumping device for artificial lifting of oil and the obtaining and recording of information from the reservoir bottom, (pressures and temperature), through production tests, temporary closing, restoration and levelling of pressures, in one single and simple operation. The data obtained is recorded in the gauges installed in the smart device, that subsequently, will allow determination of the maximum production flow and other parameters that are necessary for optimum use.

This invention can be applied on exploratory, appraisal and development wells.

The smart pump device in this invention comprises a jet pump, coupled to a bottom shut-off valve by a smart connector and this in turn is connected to a gauge-carrier by means of a bottom plug, forming a single block integrated unit. The smart device is placed at the bottom of the well, with it being lowered freely by means of the tubing, which is part of the mechanical completion of the same, through the injection from the surface of a drive fluid with a reciprocal hydraulic surface pump, centrifuge or otherwise, at low velocity and pressure till it is lodged in the sliding sleeve.

The smart device starts its operation when the drive fluid (oil or water) is injected from the surface to the jet pump, through the production tubing at a pressure that is increased up to 3500 psi. As this is not a standard pressure, it would depend on the maximum flow rate of the well and how much requires to be produced, after which the lifting of the fluids to the surface begins to take place due to the jet effect (Venturi principle) and testing is of the well is initiated to determine, on the surface, what the maximum flow of the well is, which is calculated in calibrated tanks, while the gauges lodged in the gauge carrier record the flow pressure and temperature.

When the production has stabilized, at the discretion of the technicians, the production test is ended by suspending pumping from the surface, at which point of time the shut-off valve fulfils its function of closing the well at the bottom and the gauges record the reservoir pressure, that is to say, the existing pressure, in this interval, from the reservoir to the bottom shut-off valve.

During the period of flow and closing of the well, the gauges attached to the shut-off valve, besides recording the flow pressure and the reservoir pressure, also record the variation of the temperature in each of these events.

A specific feature of this invention is that the closing at the bottom of the well is done instantaneously, thus reducing the said "full effect" to a minimum. At the moment in which the pumping is suspended, the hydrostatic pressure puts pressure on the upper ball of the bottom shut-off valve, lowering the plunger till it is seated on the lower ball, causing complete shutting-off of the bottom shut-off valve, to initiate restoration of the reservoir pressure, which continues to increase with time till it attains its maximum point, which is a very useful data for the study of the reservoir.

When injection pressure is once again applied from the surface, the jet pump restarts its operation and the vacuum generated by the Venturi effect in the jet pump raises the upper ball that is located in the plunger, the spring displaces this plunger upwards and automatically leaving the bottom shut-off valve in an open position so that the well fluids pass through it and production is restarted.

A complementary modality of the invention refers to the recovery of the smart hydraulic pumping device to the surface by levelling the hydrostatic and reservoir pressures to which the pump is subjected.

The technical advantages of this invention include providing a method to collect information on the parameters at the bottom of the well by closing the bottom valve. In particular pressure and temperature information can be collected and with this information the reservoir parameters can be determined, the reservoir limits calculated, simulation of different dynamic and flow pressures done, all of which are extremely useful in calculating the PI (productivity index of the reservoir), define a plan for exploration of the reservoir, obtain the best oil recovery factor; and finally take decisions that ensure a profitable investment.

The incorporation of a bottom shut-off valve to the jet pump, among the features of this invention, is a technological development that is hitherto unknown in the oil industry, both owing to its design, as well as its functioning, as the closing generated by a system with a plunger and two balls of a highly resistant material makes this bottom shut-off valve more efficient. Besides this the bottom shut-off valve incorporates a special by-pass that facilitates recovery of the pump to the surface.

Another technical advantage of this invention is that it includes the recording of the dynamic or flow pressure, and the temperature at the depth where the smart hydraulic pumping device is placed, in the same instant that the automatic opening of the bottom shut-off valve occurs, when the injection pressure is applied on the nozzle of the jet pump and this initiates the lifting of the reservoir fluid by the Venturi effect. This recording takes place and is continued during the entire flow operation which could be for days, months or years.

Another technical advantage of this invention is also, that it includes automatic closing of the bottom shut-off valve, when the smart apparatus detects a fall in injection pressure and initiates the restoration of the reservoir pressure from its formation to where the smart device is installed. In this instant, the reservoir's pressure and temperature values are recorded in static conditions. The reservoir operator determines the closing time of the well.

Another technical advantage of this invention is that it includes reduction to a minimum of the said "full effect" as the closing takes place at the bottom of the well instantaneously. In particular, the reduction of the "full effect" translates into a lowering of costs both in the time the equipment is immobilized as well as the well production. This application cannot be done with any known artificial lift type.

Another technical advantage of this invention includes the recovery of the pump from the bottom of the well, once the production, closing and parameter recording operations are completed. The smart device of this invention has a by-pass to level the hydrostatic and reservoir pressures to which it is subjected, without which it would be impossible to bring it back to the surface. This characteristic of the invention is different from traditional techniques that require other longer and costly operations with special equipment.

An additional advantage of this invention is the recording of the information on the well's dynamic or flow pressure, reservoir pressure during the closing period and the temperature in the two periods in one single operation. The data collected is stored in the electronic gauges assembled in the bottom shut-off valve.

IV.—BRIEF DESCRIPTION OF THE FIGURES

V.—DETAILED DESCRIPTION OF THE INVENTION

Figure 1:
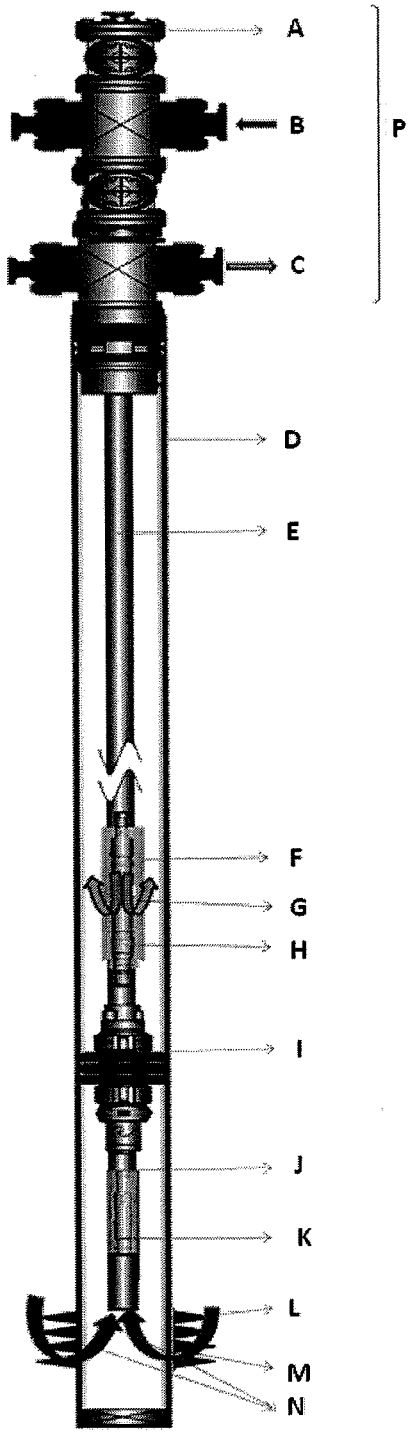
FIG. 1 represents a schematic view of the layout of an oil well with the smart device for artificial lifting of oil and obtaining and recording of information from the reservoir bottom.

FIG. 1 shows a diagram of the main parts of an oil well for operation with the smart device that is the object of this invention.

To install the smart device at the bottom of the well, the plug (A) should be disconnected from the head (P), the smart device placed inside the head, which is connected to the tubing (E) on the lower part, as illustrated in fig. The lowering of the tubing (E) should be initiated: the displacement of the smart device from the head (P) to the sleeve (F) is done by means of a drive fluid through the injection line (B) (water or oil), injected from the surface with a reciprocal hydraulic pump, centrifuge or otherwise, at a low pressure (100 to 200 psi), till it arrives at the depth of the sliding sleeve (F) and is seated. The Chevron packing (I) is a seal that serves to prevent the fluid mixture from descending to the formation, as it forms an air-tight seal between the casing tube (D) and the production tubing (E).

Figure 2:
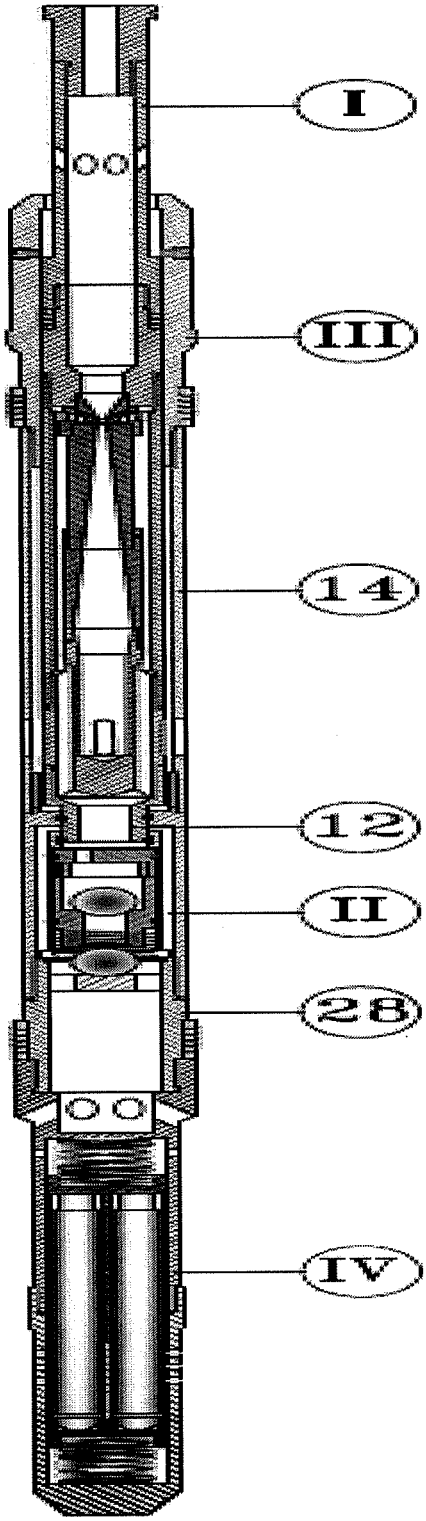
FIG. 2 is a cross-sectional view of the smart device.

The smart hydraulic pumping device, according to FIG. 2, has the following groups:

Group I: Jet pump

Group II: Bottom shut-off valve

Group III: Jet pump housing.

Group IV: Gauge-carrier and electronic gauges.

The assembling of the smart hydraulic pumping device follows the following sequence:

The lower part of the bottom shut-off valve (II) is screwed on to the Bottom smart plug (28). The upper end of the valve is screwed on to the outer tube (14) and the jet pump without the fishing neck is introduced inside the outer tube (14) and coupled to the bottom shut-off valve by means of a smart connector (12). Subsequently the upper packing mandrel (20) is mounted onto the outer tube (14) with the respective sealing elements ((17, 18 and 19).

The sealing elements that are housed in the upper packing mandrel (20) and those housed in the lower plug (28) are identical and serve to make an air-tight seal in the upper and lower sealing surfaces of the sliding sleeve (F). Next, bronze screws are lodged in the upper packing mandrel (20) to keep the pump fixed (I) in its housing and the fishing neck is screwed on and adjusted. In the lower end of the plug (28) the electronic gauge (29) carrier is installed and finally the entire unit must be adjusted and it is thus ready for displacement in the well.

This smart device is designed in different measurements; for wells with tubing with diameters of 114, 89 and 73 mm (4½", 3½" and 2⅞" inches). All the carbon steel materials used in this smart device are surface treated with nitridation processes using gases and salts.

Following the structural detail shown in FIG. 2, given below is an independent description of each of the abovementioned invention groups.

Figure 3:
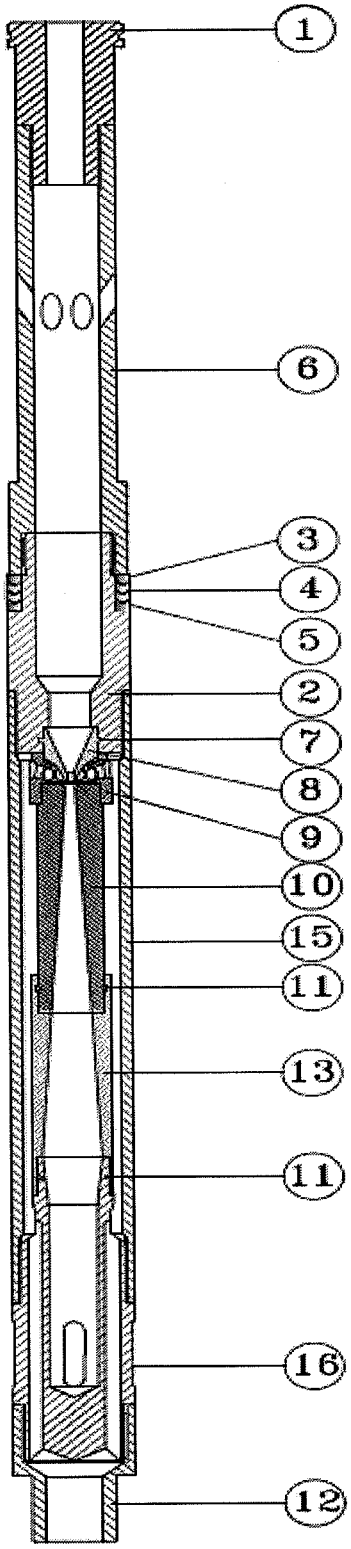
FIG. 3 is a cross-sectional view of the jet pump and its components
Figure 3A:
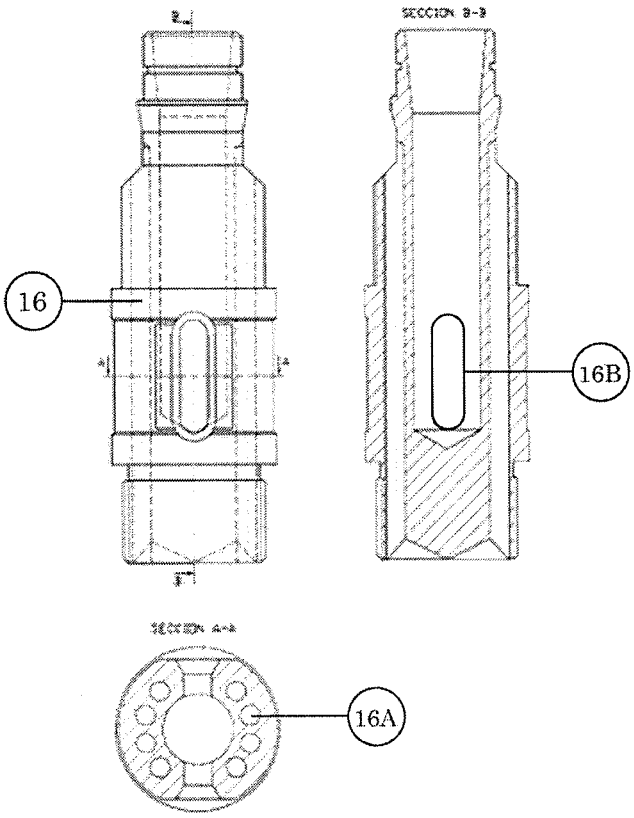
FIG. 3A represents the detail of the discharge body.
Figure 3B:
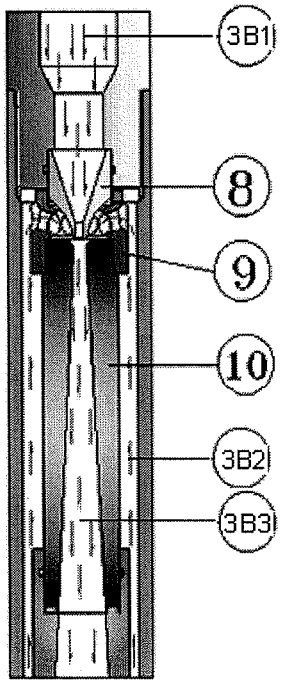
FIG. 3B represents the detail of the nozzle assembly—throat

FIG. 3 illustrates a cross-sectional view of the jet pump (I) and its components.

The fishing neck (1) is an element that serves to recover the smart device (H) when, due to the presence of carbonates or other solids accumulated on or around it, its recovery through hydraulic pressure is not permitted. In this case a steel cable should be used for this operation that is called a fishing line: the adaptor extension (6) acts as an extension to assemble the fishing neck (I) and the upper packing mandrel (2) and allows fixing the jet pump in its housing by pressure exerted by the bronze screws (34) on the outer surface of this extension (6), while it is in operation and the well is closed. Also this adaptor extension (6) shears the bronze screws (34) to open the ducts of the by-pass (23) of the bottom shut-off valve.

The upper packing mandrel (2) houses the nozzle (8) on its inner part and in the outer part the seal kit (3, 4 and 5) which contains 2 Chevron packing (4); which are centred by the centre adaptor (3), which is a "V" shaped metallic ring and adjusted by the end adaptor (5), which is also a metallic ring. The unit formed by the elements (3), (4) y (5) creates an air-tight seal which ensures the directing of the drive fluid towards the nozzle (8). In the lower part of the packing mandrel (2), where the nozzle (8) is housed, there is a O ring (7) which makes an air-tight seal.

The nozzle (8) has a conical surface on the inside and its smallest diameter can vary between 18 different measurements, depending on the production characteristics of the well. This change in the section of a larger or smaller diameter which the fluid is subjected to when it passes through the nozzle (8), results in the transformation of the potential energy of pressure to kinetic energy of the injected fluid speed, known under the name Venturi effect, which produces a vacuum (pressure differential) facilitating the reservoir fluids to enter through the nozzle retainer (9) to the throat (10). The nozzle retainer (9) also serves to maintain a separation between the nozzle (8) and the throat (10) as shown in FIG. 3. In this throat, the injection drive fluid and the production well fluid are mixed.

The throat (10) like the nozzle (8), are the two elementary parts of the pump. The efficiency of the jet pump in lifting the production from the well depends on their design. These parts are made of tungsten carbide.

The throat (10) has two sections on the inside, one constant through which the blend passes and the other in the form of a cone formed by two angles of 2° and 15°, which are designed to transform kinetic energy into potential energy and whose parts are designed in such a manner that they reduce loss of pressure due to friction and increase the efficiency of the Jet pump. The kinetic energy of the blend is transformed at the mouth of this cone into potential energy, which makes the pressure rise and reduces the speed till it arrives at the diffuser (13), which is the continuation of the cone (10); on its part the diffuser (13) connects at the upper end to the throat (10) and here the energy is increased to its maximum point to generate the lifting of the blend till the surface, thus defeating the weight of the hydrostatic column and the loss of pressure due to friction; at the lower end of the diffuser (13) it is connected to the discharge body (16), each joint has a o ring (11) that prevents leaks in the two coupled ends. Next the blend flows through the discharge body (16) and discharges through the empty space between the tubing (E) and the casing (D); the potency generated through the jet pump will be sufficient for these fluids to ascend through this empty space till they arrive at the head P, come out of the surface through line (C) and connect with the production line that goes to the production control station.

The smart connector (12) is screwed on to the lower part of the discharge body (16); this unit allows the passage of fluids from the reservoir from the bottom shut-off valve to the jet pump. Besides it opens and closes the by-pass (23) so that the pressures are levelled when the smart device is required to be recovered to the surface.

The outer tube (15) serves as a screw connection between the upper packing mandrel (2) and the discharge body (16), creating an empty space formed between the internal part of the outer tube (15), the outer walls of the throat (10) and the diffuser (13) through which the reservoir fluid circulates to later enter the throat (10) and continue its passage to the diffuser (13).

For assembling the jet pump, the diffuser (13), which has 2 O-rings (11) at its ends is mounted, and this is assembled with the throat (10) under pressure, in upper part of which is the nozzle retainer (9), on which the nozzle is placed (8). On the inside of the upper packing mandrel (2), an O ring (7) and the nozzle (8) are inserted. On the outer part of the upper packing mandrel (2) the sealing elements are placed in the following order: center adaptor (3), Chevron packing (4) and end adaptor (5); the adaptor extension (6) is screwed on to the upper part and the fishing neck (1) is placed after waiting for the smart device to be completely assembled. To complete the assembly of the pump, the discharge body (16) is joined to the upper packing mandrel (2) by means of the outer tube (15). Finally by means of the smart connector (12), the jet pump is joined with the bottom shut-off valve.

Figure 4:
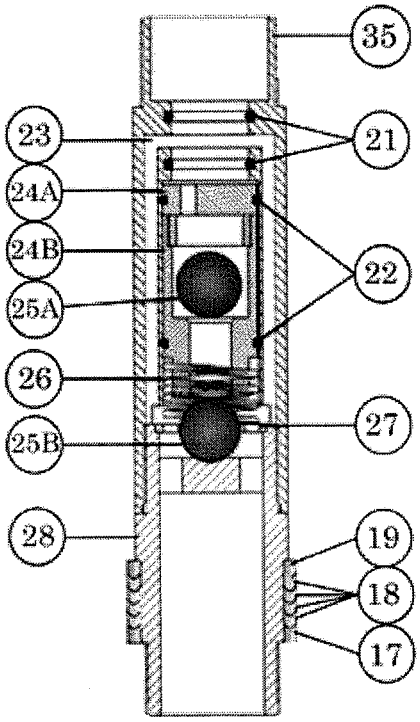
FIG. 4 represents a cross-sectional view of the bottom shut-off valve and its components and a view of the plunger position (24) on opening and closing of the bottom valve.
Figure 4:
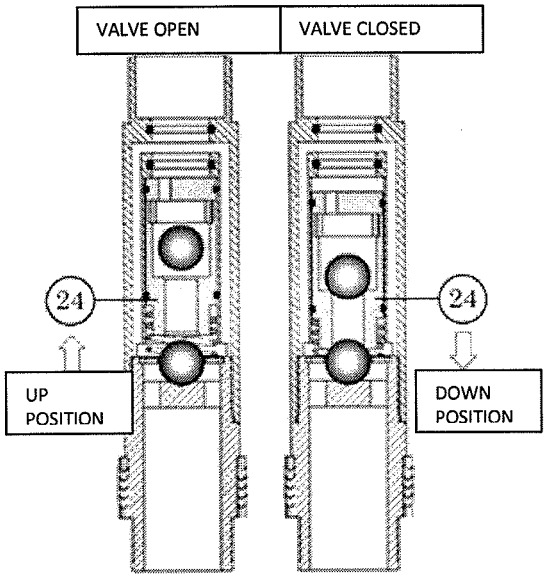
Figure 4A:
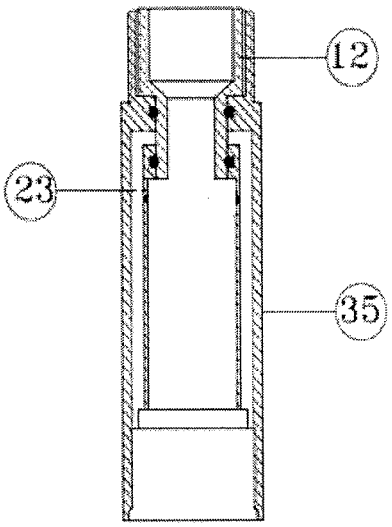
FIG. 4A represents a detail of the coupling between the smart connector and the valve housing.
Figure 4B:
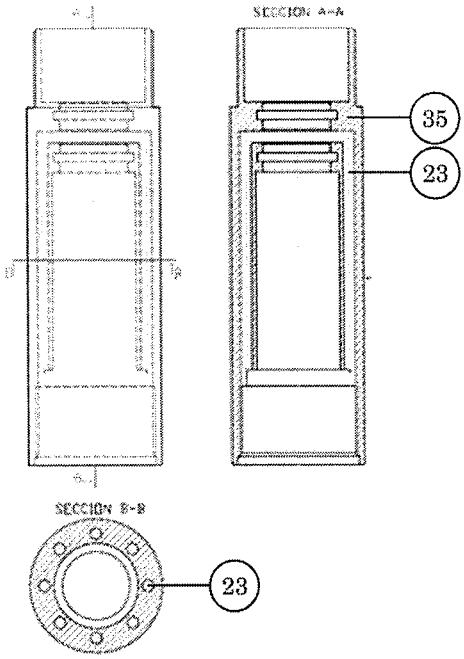
FIG. 4B represents a detail of the position of the by-pass in the smart valve housing.

FIG. 4 illustrates the bottom shut-off valve, which is connected on the upper part to the outer tube (14). This bottom shut-off valve is connected to the jet pump and is one of the fundamental parts in this invention. The valve housing (35) is the body of the valve where all its parts are housed, as shown in FIG. 4.

The plunger assembly (24) is formed by two threaded metallic parts and houses the upper ball (25A) on the inside, which is lodged on the rectified surface, the lower part of the plunger forms a seal with the lower ball (25 B) when the plunger (24) moves downwards. The O-ring elements (22) are located on the outer wall of the plunger, which generate an air-tight seal with the inner surface of the valve body.

The metallic O ring (27) sits on the lower plug (28) and acts as a stopper for the ball (25B), keeping it fixed. In the upper part of the metallic ring (27) the stainless steel spring (26) that activates the plunger (24) upwards is located, while the bottom shut-off valve is open and the jet pump is operating.

When the bottom shut-off valve is closed, the plunger (24) descends compressing the spring (26) till it is seated on the ball (25B).

The balls (25 A and B) are made of tungsten carbide, a material that has great hardness and resistance to wear and tear and corrosion, these make a metal to metal seal with the rectified surfaces of the plunger (24).

The lower plug (28) is connected to the bottom shut-off valve; on the lower part it houses the seal system (17, 18 and 19) which has 3 Chevron packing (18), which are centred by the centre adaptor (19), which is a metallic ring in the shape of a "V" and adjusted by the end adaptor (17) which is also a metallic ring. The unit formed by the elements (17, 18 and 19) creates an air-tight seal with the lower sealing surface of the sleeve in (F) in FIG. 1.

To assemble the bottom shut-off valve, the ball (25B) and the metallic O ring (27) are positioned on the lower plug (28), next the plunger (24) is assembled with the ball (25A) inside and the O-rings (22) are positioned in the by-pass (23). Next the plunger (24) is introduced in the valve housing (35), the spring is positioned (26) and the lower plug (28) is screwed on to the body of the shut-off valve (35).

Figure 5:
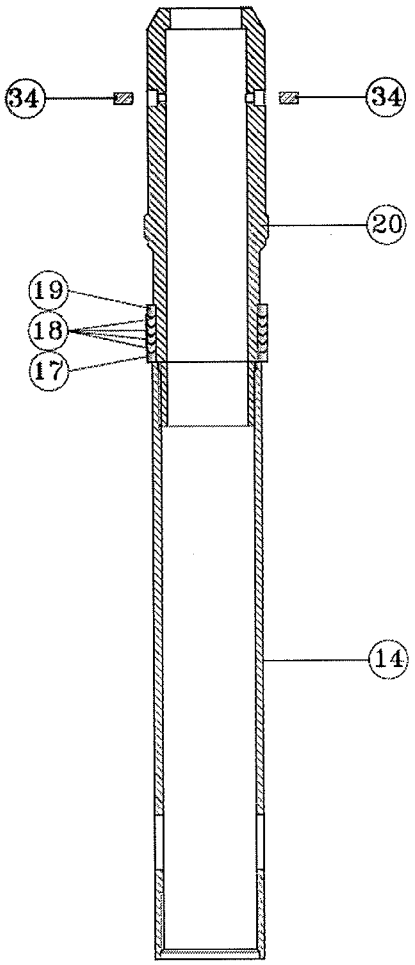
FIG. 5 is a cross-sectional view of the Jet pump housing and its components.

FIG. 5 is a cross-sectional view of the jet pump housing and its components.

The outer tube (14) houses the jet pump on the inside and is screwed on to the bottom shut-off valve at its lower end and on the upper end it is connected with the upper packing mandrel (20). Besides it also has a series of lateral perforations for discharging the pump fluids towards the empty space existing between the casing (D) and the tubing (E).

The upper packing mandrel (20) houses the jet pump seals on the inside (3, 4 and 5); on the outside it has a rib that anchors the pump when it meets the sleeve (F). The lower outer part has a seal kit (17, 18 and 19) that is assembled by screwing on to upper end of the outer tube (14). The seal kit serves as an air-tight seal between the jet pump and the sleeve (F). In the upper part there are two threaded holes on the sides where the screws (34) are screwed on.

Figure 6:
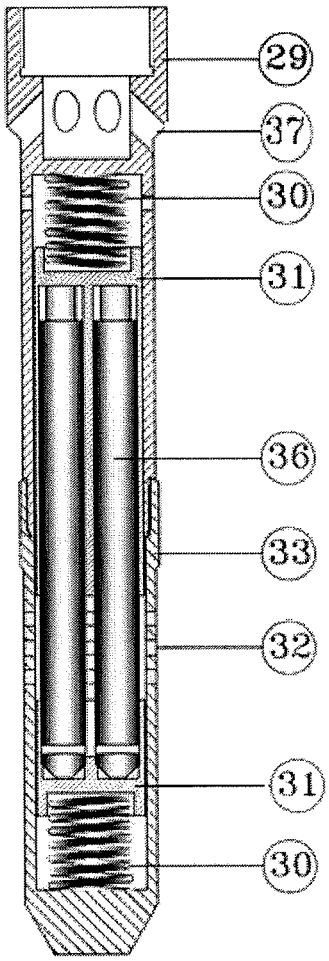
FIG. 6 is a cross-sectional view of the housing of the electronic gauges and its components.

FIG. 6 illustrates a cross-sectional view of the gauge carriers (29), which is a capsule for protection of the electronic gauges (36) against impacts or vibrations. The gauge carrier (29) is connected to the lower plug (28) on its lower end, it also has a spring (30), a Teflon MG 2 housing (31) and a retainer nut and carrier (33). The Teflon MG 2 housing (31) is fabricated in a smooth but temperature resistant material and insulates and completely protects the electronic gauges avoiding metal-metal contact. The ducts for entry of fluid and pressure to the gauge (32) communicate with the well fluids and make contact with the gauges (36). It must be highlighted that the gauge carrier has a special design which is adapted to the dimensional characteristics of electronic gauges.

The gauge carrier (29) is also a Chevron packing kit retainer (17,18 and 19) when it is connected to the lower plug (28). This packing kit forms a seal in the lower part of the jet pump, with the sliding sleeve (F); the ducts for entry of fluids from the well to the pump are located on the upper part of this housing.

To assemble the gauge carrier (29) the electronic gauges (36) are introduced in the Teflon MG 2 housing (31), the springs (30) are positioned one at each end, it is entered into the housing (29) and adjusted with the retainer nut (33).

The electronic gauges (36) record and store information on the flowing pressure and temperature while the pump is operating, as well as the restoration of the reservoir pressure and the temperature when it is closed.

Artificial Lift

After the smart hydraulic pumping device (H) is seated in the sliding sleeve (F) the drive fluid that descends through the tube (E) gradually increases in pressure till it attains the recommended pressure for the production test (more than 1000 psi to 3500 psi) and comes into the jet pump through the fishing neck (1) till it arrives in the nozzle (8) where there is a transformation of the potential energy of pressure to kinetic energy of speed due to the Venturi effect, creating a void, at which point of time the bottom shut-off valve is automatically opened due to the upward push generated by the spring (26) on the plunger (24). In turn the plunger separates the ball (25 B) from its seating, allowing the passage of the reservoir fluids from the lower plug (28) towards the inside of the shut-off valve, crossing through the inside of the plunger and lifting the ball (25 A), next the fluid passes through the smart connector (12), moving towards the holes of the discharge body (16) and thus arrives at the empty space between the inner surface of the outer tube (15) and the outer surface of the diffuser (13), ending its trajectory at the suction point of the pump, which is the nozzle retainer (9). At this point of time, it is dragged and forced to enter the throat (10) to mix with the injection fluid and this mixture of fluids continues through the diffuser (13) and continues its trajectory till the discharge body (16), coming out towards the empty space existing between the casing tube (D) and the production tube (E), to finally come up to the surface and come out of the production line (C).

During the operation of the smart hydraulic pumping device, production tests are carried out on the surface, calculating the production in barrels per hour, produced by the well to have a projected data of daily production. This projection would allow the user to make the required calculations; while this takes place, the gauges housed at the bottom of the well continue to record the flowing pressure and temperature of the reservoir fluids.

Temporary Closing of the Well

The temporary closing of the well, generated by the closing of the bottom valve, refers specifically to insulating the reservoir pressure with respect to the hydrostatic pressure of the fluid column, which is located on the smart device and the reservoir pressure.

The temporary closing of the well is initiated after the number of flow hours of the well programmed by the user have been completed, for which the injection of the fluid from the surface to the jet pump is suspended and the well head valves are closed; at this point of time due to hydraulic push of the hydrostatic pressure on the shut off valve, the upper ball (25A) along with the plunger (24) descends, defeating the resistance of the spring (26) till it is seated on the lower ball (25B), thus closing the bottom shut-off valve and automatically suspending the passage of fluid from the reservoir to the jet pump.

The design of the plunger with a double seal system, by means of the upper and lower balls (25 A and 25 B) is an innovation of this invention, that is hitherto not known in the state of the technique, which guarantees a more secure and efficient closing, particularly in wells with large reservoir pressure, as the lower ball (25 B) prevents the reservoir pressure from lifting the upper ball (25 A) and the bottom valve from opening.

During the temporary closing of the well, the "full effect" is reduced to a minimum, allowing the reservoir to recover its natural pressure, which increases with the passage of time till attaining its maximum point, information that is very useful for the reservoir operators for the calculation of reserves and the well potential. The closing time of the well is determined by the reservoir operator.

Recovery of the Smart Device

Once the production, closing and parameter recording operations are completed, the device should be recovered to the surface to remove the gauges from their housing and download the information to a computer.

For recovering the smart device, it is necessary to level the existing pressures on and under the bottom shut-off valve by means of a by-pass, a device, without with the recovery of the smart device to the surface would be impossible.

The opening of the by-pass (23) is done hydraulically or mechanically: for the first case, it is done by injecting the drive fluid in reverse at a low pressure (100 to 500 psi) through the empty space that is found between the production tubing (E) and the casing tubing (D) so that the jet pump is displaced upwards; and in the second case, this is done with a cable line tethering the device from its fishing neck.

With any of the two procedures the jet pump should be displaced upwards to a length of 38.1 mm (1.5 inches) shearing the screws (34). This displacement will make the smart connector (12) come out of the valve housing (35), at this instant the by-pass (23) opens making the pressure level and the smart device can be released from the sleeve (F) and recovered to the surface hydraulically.

The invention claimed is:

1. A smart hydraulic pumping device for recovery of oil, obtaining and recording of information from a bottom of a reservoir, comprising:

a jet pump having an adaptor extension for assembling a fishing neck with an upper packing mandrel of the jet pump;

a bottom shut-off valve comprising:

a plunger assembly having two rectified surfaces where an upper ball and a lower ball are housed for air-tight sealing of the bottom shut-off valve; and a by-pass placed length-wise in a peripheral part of a valve housing of the bottom shut-off valve and configured to level a pressure when recovery of the smart hydraulic pumping device is necessary;

wherein the bottom shut-off valve is coupled to the jet pump by means of a smart connector, which is connected to a lower part of a discharge body of the jet pump and on a lower end of the bottom shut-off valve to allow reservoir fluids to pass from the bottom shut-off valve to the jet pump; and a gauge carrier installed at a bottom of the valve housing of the bottom shut-off valve through a lower plug, and configured to house a plurality of electronic gauges.

2. The smart hydraulic pumping device according to claim 1, wherein the lower plug has an upper threaded part which is connected to the bottom shut-off valve and a lower threaded part which is connected to the gauge carrier and is configured to provide a seat for the lower ball and a metallic O ring.

3. The smart hydraulic pumping device according to claim 1, wherein the adaptor extension is configured to fix the jet pump in a jet pump housing through pressure exerted by anchoring screws on an outer surface of the adaptor extension, and is further configured to shear the anchoring screws when the jet pump is displaced upwards in the operation for recovery of the smart hydraulic pumping device, and when the smart connector is disengaged from the by-pass of the bottom shut-off valve.

4. The smart hydraulic pumping device, according to claim 1, wherein the jet pump also includes a jet pump housing formed by an outer tube that is connected at a lower end of a body of the bottom shut-off valve and wherein the upper part of the outer tube is connected to the upper packing mandrel that houses two threaded holes where screws are screwed on.

5. The smart hydraulic pumping device according to claim 1, wherein the bottom shut-off valve includes the valve housing, the plunger assembly, a spring and the upper and lower balls made of tungsten carbide.

6. The smart hydraulic pumping device according to claim 1, wherein the plurality of electronic gauges includes electronic pressure and temperature gauges, wherein the gauge carrier houses the electronic pressure and temperature gauges and contains entry ducts for the reservoir fluids to enter the electronic pressure and temperature gauges, springs and a housing which insulates and protects the electronic gauges to avoid metal-to-metal contact and further the gauge carrier is configured to act as a packing kit retainer when the gauge carrier is screwed on to the lower plug.

7. A method for recovery of oil and obtaining and recording of information from a bottom of a reservoir using a smart hydraulic pumping device which contains a jet pump, a bottom shut-off valve and a gauge carrier that houses electronic gauges, coupled to each other to form an integrated single block unit, which uses hydraulic energy of a drive fluid that is injected into a well from a surface, comprising:

positioning the smart hydraulic pumping device in the well;

generating artificial lift of fluid for production, calculating a flow on the surface, and recording pressure and temperature in the electronic gauges;

facilitating closing of the well, recording pressure and temperature of the reservoir in the electronic gauges and restoration of the pressure of the reservoir; and facilitating levelling of pressures and recovering the smart hydraulic pumping device towards the surface.

8. The method for recovery of oil and obtaining and recording of information from the bottom of the reservoir according to claim 7, wherein the positioning of the smart hydraulic pumping device in the well is initiated when a plug is disconnected from a head, introducing the jet pump on an inside of the head, which is connected to tubing, and initiating displacement of the smart hydraulic pumping device through the tubing until the jet pump of the smart hydraulic pumping device is housed in a sliding sleeve at a bottom of the well, the displacement being done by means of a drive fluid through an injection line (water or oil) injected from the surface with a reciprocal hydraulic pump at a low pressure (100-200 psi) until the jet pump reaches a depth of the sliding sleeve and is seated.

9. A The method for recovery of oil and obtaining and recording of information from the bottom of the reservoir according to claim 7, wherein the artificial lift of fluid is done after the jet pump of the smart hydraulic pumping device is seated in a sliding sleeve and the drive fluid is injected at an increasing pressure (more than 1000 to 3500 psi) from the surface to the jet pump through a fishing neck until the drive fluid arrives at a nozzle where a transformation of potential energy of pressure of the drive fluid injected to kinetic energy of speed takes place due to a Venturi effect, creates a vacuum, when the bottom shut-off valve automatically opens due to an upward push generated by a spring on a plunger, which in turn separates a ball from a seat on which the ball is seated, allowing passage of fluid from the reservoir from a lower plug towards an inside of the bottom shut off valve, going through an inside of the plunger, lifting the ball and crossing a smart connector, moving towards holes of a discharge body of the jet pump and in this manner arriving at an empty space between an inner surface of an outer tube and an outer surface of a diffuser, ending fluid trajectory at a suction point of the jet pump, which is a nozzle retainer where the fluid is dragged and forced to enter a throat to mix with the drive fluid and this mixture of fluids is configured to continue flowing through the diffuser until the mixture of fluids reaches the discharge body, moving towards an empty space between a casing tube and a production tube and finally lifting towards the surface and coming out through a production line.

10. The method for recovery of oil and obtaining and recording of information from the bottom of the reservoir according to claim 9, wherein when the bottom shut-off valve is opened and the lifting of the mixture of fluids to the surface takes place, testing of the well is done to determine maximum flow of the mixture of fluids on the surface and the electronic gauges housed in the gauge carrier continue to record the pressure and the temperature of the reservoir.

11. A The method for recovery of oil and obtaining and recording of information from the bottom of the reservoir according to claim 7, wherein temporary closing of the well is started after completing a programmed flow period, suspending injection of the drive fluid from the surface to the jet pump and closing valves of a well head, further due to a hydraulic push of hydrostatic pressure that is acting on the bottom shut-off valve, an upper ball along with a plunger descends, overcoming resistance of a spring until the plunger is seated on a lower ball, thus closing the bottom shut-off valve and automatically suspending passage of the fluid from the reservoir to the jet pump, further restoration of pressure of the reservoir is initiated, reducing a "full effect" to a minimum.

12. The method for recovery of oil and obtaining and recording of information from the reservoir bottom according to claim 11, wherein at a time in which the bottom shut-off valve closes and the closing of the well is generated, the electronic gauges record the pressure of the reservoir and the temperature, wherein an existing pressure in this interval from the reservoir to the bottom shut-off valve, simultaneously initiates restoration of the reservoir pressure, which increases with a passage of time until the reservoir attains maximum pressure.

13. The method according to claim 11, wherein a recovery of the smart hydraulic pumping device to the surface is done by levelling existing pressures above and below the bottom shut-off valve by opening a by-pass and injecting the drive fluid in reverse, at a low pressure (100 to 500 psi) through an empty space that is found between a production tube and a casing tube, so that the jet pump is displaced upwards for a length of approximately 3.81 mm (1.5 inches), shearing screws and a smart connector and comes out of a valve housing, while the bypass is open, causing pressure to be levelled and the smart hydraulic pumping device to be released from a sliding sleeve and recovered to the surface.

* * * * *